US010767378B2

(12) United States Patent
Seshappa et al.

(10) Patent No.: US 10,767,378 B2
(45) Date of Patent: Sep. 8, 2020

(54) THERMALLY BROKEN ANCHOR FOR LIFTING A CONCRETE SANDWICH PANEL

(71) Applicant: Meadow Burke, LLC, Riverview, FL (US)

(72) Inventors: Venkatesh Seshappa, Ames, IA (US); Darryl Dixon, Ankeny, IA (US); Michael J. Recker, Palmetto, FL (US)

(73) Assignee: Meadow Burke, LLC, Riverview, FL (US)

( * ) Notice: Subject to any disclaimer, the term of this patent is extended or adjusted under 35 U.S.C. 154(b) by 7 days.

(21) Appl. No.: 15/961,472

(22) Filed: Apr. 24, 2018

(65) Prior Publication Data

US 2018/0305939 A1 Oct. 25, 2018

Related U.S. Application Data

(60) Provisional application No. 62/489,216, filed on Apr. 24, 2017.

(51) Int. Cl.

| | |
|---|---|
| ***E04G 21/14*** | (2006.01) |
| ***E04C 2/288*** | (2006.01) |
| *E04C 2/00* | (2006.01) |

(52) U.S. Cl.

CPC ..... *E04G 21/147* (2013.01); *E04C 2/288* (2013.01); *E04G 21/142* (2013.01); *E04G 21/145* (2013.01); *E04C 2002/002* (2013.01)

(58) Field of Classification Search

CPC ... E04G 21/147; E04G 21/142; E04G 21/145; E04G 15/04; E04C 2/288; E04C 2002/002; E04C 2/284; E04C 2/2885; E04B 1/3511; E04B 1/41

USPC ... 52/125.4, 125.5, 309.8, 309.12, 698, 707, 52/125.2, 125.3, 701, 704

See application file for complete search history.

(56) References Cited

U.S. PATENT DOCUMENTS

| | | | | |
|---|---|---|---|---|
| 1,586,833 A * | 6/1926 | Nicholson | ..... | E04F 11/1812 52/708 |
| 2,886,370 A * | 5/1959 | Liebert | ..... | B28B 23/005 294/89 |
| 3,095,672 A * | 7/1963 | Di Tullio | ..... | E04B 1/4107 52/710 |
| 3,453,796 A * | 7/1969 | Gutmann | ..... | E04B 1/41 52/704 |
| 3,712,014 A * | 1/1973 | Waerner | ..... | E04C 5/168 52/707 |

(Continued)

FOREIGN PATENT DOCUMENTS

| | | | | |
|---|---|---|---|---|
| WO | WO-2008078008 A1 * | 7/2008 | ..... | E04G 21/142 |
| WO | WO-2014185911 A1 * | 11/2014 | ..... | E04G 21/142 |

*Primary Examiner* — Ryan D Kwiecinski
*Assistant Examiner* — Matthew J Gitlin
(74) *Attorney, Agent, or Firm* — Sheridan Ross P.C.

(57) ABSTRACT

A lifting system is provided that prevents a thermal bridge between concrete layers of a precast concrete structure. In some precast concrete panels, an insulation layer is provided between concrete layers. Lifting systems of the present invention allow lifting forces from a hoisting system to be transferred to the concrete panels without creating a thermal bridge between the concrete layers, and thus, reducing the effectiveness of the insulation layer. In some embodiments, a multi-plate configuration allows a central plate to distribute a lifting force to the concrete layers and then rotate away to prevent a thermal bridge between concrete layers.

20 Claims, 4 Drawing Sheets

(56) References Cited

U.S. PATENT DOCUMENTS 4,068,878 A * 1/1978 Wilner ..... B66C 1/663 294/82.17
4,869,042 A * 9/1989 Fricker ..... E04G 21/142 52/699
5,440,845 A * 8/1995 Tadros ..... E04C 2/044 52/309.12
5,625,993 A * 5/1997 Kelly ..... E04B 1/4107 52/506.05
5,857,296 A * 1/1999 Niday ..... E04G 21/142 52/125.1
5,924,260 A * 7/1999 Austin ..... E04B 1/4107 403/363
6,088,985 A * 7/2000 Clark ..... E04C 2/044 52/309.11
6,092,849 A * 7/2000 Zambelli ..... E04G 21/142 294/82.1
6,230,465 B1 5/2001 Messenger et al.
6,701,683 B2 3/2004 Messenger et al.
6,729,090 B2 5/2004 Messenger et al.
6,761,007 B2 7/2004 Lancelot, III et al.
6,898,908 B2 5/2005 Messenger et al.
7,100,336 B2 9/2006 Messenger et al.
7,627,997 B2 12/2009 Messenger et al.
7,735,270 B2 * 6/2010 Olle ..... F24F 13/0254 52/167.9
8,667,746 B1 * 3/2014 Francies, III ..... E02D 35/00 52/122.1
8,806,811 B1 8/2014 Tadros et al.
8,959,847 B2 2/2015 Recker et al.
9,151,065 B1 * 10/2015 Francies, III ..... E04G 21/142
9,493,946 B2 * 11/2016 Foderberg ..... E04C 2/049
9,803,354 B1 * 10/2017 Francies, III ..... E04B 1/4107
10,287,785 B1 * 5/2019 Tadros ..... F16B 45/00
2005/0081484 A1 * 4/2005 Yland ..... E04C 2/049 52/782.1
2007/0039281 A1 * 2/2007 Zambelli ..... E04B 1/4107 52/710
2010/0058677 A1 * 3/2010 Arteon ..... E04G 21/142 52/122.1
2012/0060435 A1 * 3/2012 Heudorfer ..... E04B 1/4107 52/181
2013/0036678 A1 * 2/2013 Nyce ..... E04H 12/2276 52/105
2014/0318074 A1 * 10/2014 Heudorfer ..... E04B 1/4107 52/710
2019/0063088 A1 * 2/2019 Hansort ..... E04G 15/04

* cited by examiner

THERMALLY BROKEN ANCHOR FOR LIFTING A CONCRETE SANDWICH PANEL

CROSS-REFERENCE TO RELATED APPLICATIONS

This application claims priority under 35 U.S.C. § 119(e) to U.S. Provisional Patent Application Ser. No. 62/489,216 filed Apr. 24, 2017, which is incorporated herein in its entirety by reference.

FIELD OF THE INVENTION

The present invention is generally directed to lifting anchors used in conjunction with precast concrete panels, and more specifically to thermally efficient anchors, the associated insulated precast concrete panels, and methods of use.

BACKGROUND OF THE INVENTION

Precast concrete panels and integral lifting anchors are widely used in the construction industry. Traditional concrete structures are formed in place and on site, whereas precast concrete panels are poured and cured off site in a modern manufacturing facility before being transported to the building site. Precast concrete panels allow for better quality control and cheaper costs since precast forms can be reused hundreds or thousands of times. The popularity of precast concrete panels has translated into a greater variety of types and styles of panels.

One particular variation of precast concrete panel is an insulated precast concrete panel. Typically, this type of precast concrete panel has an inner precast concrete layer, or wythe, and an outer precast concrete layer with an insulating layer positioned therebetween. Like traditional precast concrete panels, an insulated precast concrete panel must be positioned in place at the building site. In prior art devices, a lifting member such as a steel anchor is interconnected to both precast concrete layers and spans the insulated gap between the layers. After the insulated precast concrete panel is placed in the desired position, the lifting member is typically retained in place since it is embedded in the hardened concrete. However, steel and other metals used to form lifting members are thermally inefficient since they readily transfer heat, and therefore, a thermal bridge is created through the insulation layer, which reduces the thermal effectiveness of the insulation layer and the insulated precast concrete panel.

Prior art devices do not adequately address the thermal bridge problem described above. Examples of prior art devices may be found in U.S. Pat. Nos. 5,857,296; 8,806,811; 6,761,007; and 8,959,847, which are incorporated herein in their entireties by reference. These references describe devices that provide the lifting function for precast concrete panels, or even alternative materials to help mitigate the thermal bridge issue, but none of the prior art references adequately address the problems described above.

SUMMARY OF THE INVENTION

The above needs and other needs are addressed by the various embodiments and configurations of the present invention. It is an objective of the present invention to provide a lifting system that distributes a lifting force from a hoisting system to an anchor embedded in one or more concrete layers of a precast concrete structure while preventing a thermal bridge between the concrete layers. The system must be simplistic in design and cost effective. It is a further objective of the present invention to provide a lifting system that can be readily integrated into existing manufacturing processes and existing hoisting systems for moving precast concrete structures into a predetermined position and orientation.

It is an aspect of embodiments of the present invention to provide a multi-plate lifting system that can lift a precast concrete structure while preventing a thermal bridge between concrete layers of the structure. The lifting system may comprise a central plate flanked by wing plates, and wherein the wing plates are connected to the concrete layers of the structure. A lifting clutch can be selectively interconnected to the central plate to provide a lifting force to the central plate, which in turn transfers the lifting force to the wing plates and the concrete layers. The central plate has extensions that protrude into the wing plates, and lifting edges of the extensions of the central plate allow the central plate to transfer the lifting forces to the wing plates and the concrete layers. Once the precast concrete structure is in position, the central plate can be rotated to break out of the plane with the wing plates such that a thermal bridge is not created between concrete layers. The central plate can be removed or left in place, and further, the recess and/or space around the central plate can be filled with a grout material or other filler material such as insulation or concrete.

It is a further aspect of embodiments of the present invention to provide a single plate lifting system that can lift a precast concrete structure while preventing a thermal bridge between concrete layers of the structure. The single plate also has apertures for connection to concrete layers as well as a central aperture to receive a lifting clutch. The lifting plate may be comprised of more insulating material that is substantially aligned with one or more apertures to prevent a thermal bridge. In some embodiments, fiberglass or carbon fiber layers can extend substantially parallel to the insulation and concrete layers, or even form part of those layers. The fiber layers can be substantially aligned with the apertures and form part of a composite, precast concrete structure. In addition, filament windings can be included to reinforce the fiber layers.

It is another aspect of embodiments of the present invention to provide an anchor made from an insulating material to prevent a thermal bridge between concrete layers of a precast concrete structure. The anchor can have substantially parallel legs with ends that extend at 90° angles from the legs. The anchor can include, non-thermally conductive fibers such as carbon or glass formed into a prismatic section by pultrusion or injection molding. Accordingly, the anchor prevents a thermal bridge between concrete layers of a precast concrete structure.

One particular embodiment of the present invention is a thermally efficient lifting apparatus for a precast concrete panel, comprising a first wing plate having a first recess, the first wing plate adapted for connection to a first concrete layer of a precast concrete panel; a second wing plate having a second recess, the second wing plate adapted for connection to a second concrete layer of the precast concrete panel; a central plate having a first extension at least partially disposed in the first recess of the first wing plate, wherein a first lifting edge of the first extension contacts the first wing plate, and the central plate having a second extension at least partially disposed in the second recess of the second wing plate, wherein a second lifting edge of the second extension contacts the second wing plate; and wherein the lifting edges are configured to transfer a force from the central plate to the wing plates, and wherein the central plate is configured to selectively rotate out of a common plane with the wings plates to disengage the lifting edges from the wing plates.

In some embodiments, the lifting apparatus further comprises a casing enclosing at least a portion of the first wing plate, at least a portion of the second wing plate, and at least a portion of the central plate to maintain an alignment of the plates in the common plane prior to rotation of the central plate. In various embodiments, the central plate has a central aperture configured to receive a lifting mechanism, the first wing plate comprises an aperture adapted for connection to the first concrete layer of the precast concrete panel, and the second wing plate comprises an aperture adapted for connection to the second concrete layer of the precast concrete panel.

In some embodiments, the first leading edge forms a first angle with a horizontal direction of the apparatus, and the second leading edge forms a second angle with the horizontal direction, wherein the first and second angles are between approximately 25 and 45 degrees. In various embodiments, a first side edge of the first extension contacts the first wing plate, and a second side edge of the second extension contacts the second wing plate, wherein the side edges are substantially oriented in a vertical direction of the apparatus.

Another particular embodiment of the present invention is a thermally efficient lifting system for a precast concrete panel, comprising a precast concrete panel having a first concrete layer, a second concrete layer, and an insulation layer positioned between the concrete layers; a first wing plate embedded in the first precast concrete layer; a second wing plate embedded in the second precast concrete layer, wherein the first wing plate and the second wing plate are aligned in a common plane; and a central plate having a first extension at least partially disposed in a first recess of the first wing plate, wherein a first lifting edge of the first extension contacts the first wing plate, and the central plate having a second extension at least partially disposed in a second recess of the second wing plate, wherein a second lifting edge of the second extension contacts the second wing plate, and wherein the central plate is configured to selectively rotate out of the common plate to disengage the lifting edges from the wing plates.

In various embodiments, the system further comprises a void former at least partially defining a space around the central plate. In some embodiments, the void former has a slot that engages at least a portion of the first wing plate, at least a portion of the second wing plate, and at least a portion of the central plate to retain alignment of the first wing plate, the second wing plate, and the central plate in the common plane. In various embodiments, the first wing plate, the second wing plate, and the central plate are encased into a single plastic casing. In some embodiments, the first and second lifting edges are configured to disengage from the wing plates when a predetermined torque is applied to the central plate about an axis aligned with the common plane.

In various embodiments, at least one of the first wing plate, the second wing plate, and the central plate comprises at least one of a steel material, a plurality of oriented fibers, a fiberglass material, a carbon fiber material, a woven fiber reinforced by filament windings, and combinations thereof. In some embodiments, the first wing plate has an aperture configured to connect to a reinforcement structure of the first concrete layer, and the second wing plate has an aperture configured to connect to the reinforcement structure. In various embodiments, the central plate has an aperture configured to receive a lifting force, wherein the lifting force is transmitted through the lifting edges to the wings plates and to the concrete layers.

A further particular embodiment of the present invention is a lifting anchor for a precast concrete panel comprising a body having a composite material, wherein the composite material has a woven layer and a binder layer; a first aperture adapted to connect to a first concrete layer of a precast concrete panel; a second aperture adapted to connect to a second concrete layer of the precast concrete panel; a central aperture adapted to receive a clutch from a hoist system, wherein the central aperture is positioned between the first and second apertures in a horizontal direction of the body; and at least one winding reinforcement oriented in a vertical direction of the body and aligned with at least one of the first aperture, the second aperture, and the central aperture in the horizontal direction.

In some embodiments, the woven layer comprises at least one of a carbon fiber and a glass fiber, and the binder layer is a resin. In various embodiments, the at least one winding reinforcement is interwoven with the woven layer. In some embodiments, the at least one winding reinforcement comprises a first winding reinforcement oriented in the vertical direction of the body and aligned with the first aperture in the horizontal direction; a second winding reinforcement oriented in the vertical direction of the body and aligned with the second aperture in the horizontal direction; and a central winding reinforcement oriented in the vertical direction of the body and aligned with the central aperture in the horizontal direction.

In various embodiments, the at least one winding reinforcement extends from a bottom edge of the body to a top edge of the body. In some embodiments, the first and second apertures are positioned a first distance from a bottom edge of the body, and the central aperture is positioned a longer, second distance from the bottom edge. In various embodiments, the composite material has a thermal conductivity lower than 0.25 W/(m·K).

Yet another particular embodiment of the present invention is a method for using a thermally efficient lifting anchor for a precast concrete panel, comprising (i) providing a lifting anchor in a precast concrete panel, the precast concrete panel having an insulation layer positioned between a first concrete layer and a second concrete layer, and the lifting anchor having a first wing plate embedded in the first concrete layer, a second wing plate embedded in the second concrete layer, and a central plate positioned between the first and second wing plates; (ii) engaging a lifting mechanism of a hoist system to the central plate and transferring a lifting force from the hoist system to the central plate, which distributes the lifting force to the wing plates and the concrete layers; (iii) positioning the precast concrete structure in a predetermined position and disengaging the lifting mechanism from the central aperture of the central plate; and (iv) rotating the central plate out of alignment with the wing plates to preserve the insulation layer.

In some embodiments, the method further comprises (v) positioning a first extension of the central plate into a first recess of the first wing plate, and positioning a second extension of the central plate into a second recess of the second wing plate, wherein the extensions each have a lifting edges to distribute the lifting force to the wing plates and the concrete layers. In various embodiments, the method further comprises (vi) removing the central plate from the precast concrete structure after rotating the central plate out of alignment with the wing plates; and (vii) filling in the space in the insulation layer with a thermally efficient, nonconductive material having at least one of a grout material, an insulation material, and a concrete material.

The Summary of the Invention is neither intended nor should it be construed as being representative of the full extent and scope of the present invention. The present invention is set forth in various levels of detail in the Summary of the Invention as well as in the attached drawings and the Detailed Description of the Invention and no limitation as to the scope of the present invention is intended by either the inclusion or non-inclusion of elements or components. Additional aspects of the present invention will become more readily apparent from the Detailed Description, particularly when taken together with the drawings.

The above-described embodiments, objectives, and configurations are neither complete nor exhaustive. As will be appreciated, other embodiments of the invention are possible using, alone or in combination, one or more of the features set forth above or described in detail below.

The phrases "at least one," "one or more," and "and/or," as used herein, are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" means A alone, B alone, C alone, A and B together, A and C together, B and C together, or A, B, and C together.

Unless otherwise indicated, all numbers expressing quantities, dimensions, conditions, and so forth used in the specification and claims are to be understood as being modified in all instances by the term "about."

The term "a" or "an" entity, as used herein, refers to one or more of that entity. As such, the terms "a" (or "an"), "one or more," and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C. § 112(f). Accordingly, a claim incorporating the term "means" shall cover all structures, materials, or acts set forth herein, and all of the equivalents thereof. Further, the structures, materials, or acts and the equivalents thereof shall include all those described in the summary of the invention, brief description of the drawings, detailed description, abstract, and claims themselves.

BRIEF DESCRIPTION OF THE DRAWINGS

The accompanying drawings, which are incorporated in and constitute a part of the specification, illustrate embodiments of the invention and together with the Summary of the Invention given above and the Detailed Description of the drawings given below, serve to explain the principles of these embodiments. In certain instances, details that are not necessary for an understanding of the invention or that render other details difficult to perceive may have been omitted. It should be understood, of course, that the invention is not necessarily limited to the particular embodiments illustrated herein. Additionally, it should be understood that the drawings are not necessarily to scale.

Figure 1A:
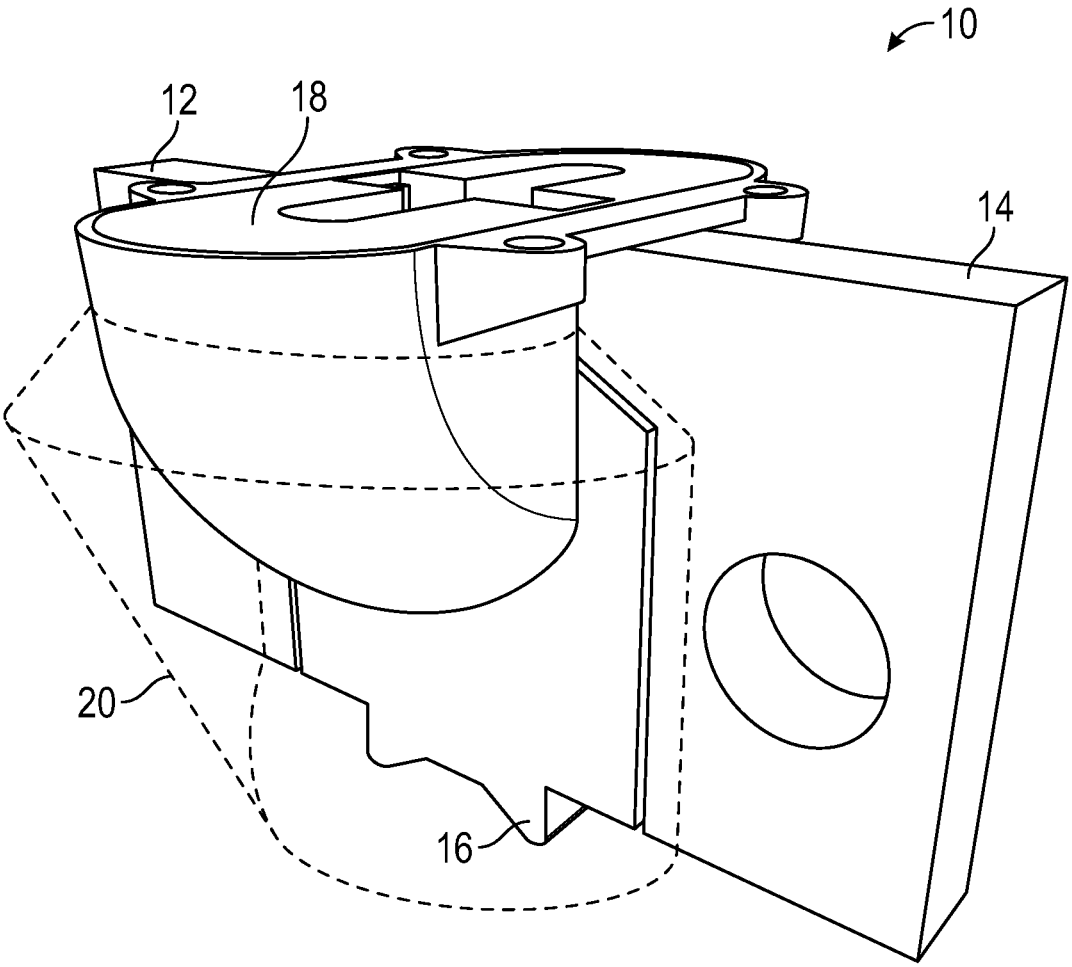
FIG. 1A is a perspective view of a lifting system in accordance with one embodiment of the present invention.

Similar components and/or features may have the same reference label. Further, various components of the same type may be distinguished by following the reference label by a letter that distinguishes among the similar components. If only the first reference label is used, the description is applicable to any one of the similar components having the same first reference label irrespective of the second reference label.

A list of the various components shown in the drawings and associated numbering is provided herein:

| Number | Component |
|---|---|
| 10 | Lifting System |
| 12 | First Wing Plate |
| 14 | Second Wing Plate |
| 16 | Central Plate |
| 18 | Void Former |
| 20 | Space |
| 22 | First Aperture |
| 24 | Second Aperture |
| 26 | Central Aperture |
| 27 | Precast Concrete Structure |
| 28 | First Recess |
| 29 | First Concrete Structure |
| 30 | Second Recess |
| 31 | Insulation Layer |
| 32 | First Extension |
| 33 | Second Concrete Layer |
| 34 | Second Extension |
| 35 | Casing |
| 36 | First Lifting Edge |
| 38 | Second Lifting Edge |
| 40 | Lifting Plate |
| 42 | Fiber Layer |
| 44 | Binding Layer |
| 46 | Winding |
| 48 | Anchor |
| 50 | Leg |
| 52 | End |

DETAILED DESCRIPTION

The present invention has significant benefits across a broad spectrum of endeavors. It is the Applicant's intent that this specification and the claims appended hereto be accorded a breadth in keeping with the scope and spirit of the invention being disclosed despite what might appear to be limiting language imposed by the requirements of referring to the specific examples disclosed. To acquaint persons skilled in the pertinent arts most closely related to the present invention, a preferred embodiment that illustrates the best mode now contemplated for putting the invention into practice is described herein by, and with reference to, the annexed drawings that form a part of the specification. The exemplary embodiment is described in detail without attempting to describe all of the various forms and modifications in which the invention might be embodied. As such, the embodiments described herein are illustrative, and as will become apparent to those skilled in the arts, may be modified in numerous ways within the scope and spirit of the invention.

Although the following text sets forth a detailed description of numerous different embodiments, it should be understood that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning.

Various embodiments of the present invention are described herein and as depicted in the drawings. It is expressly understood that although the figures depict plates and void formers, and methods and systems for using the same, the present invention is not limited to these embodiments.

Figure 1B:
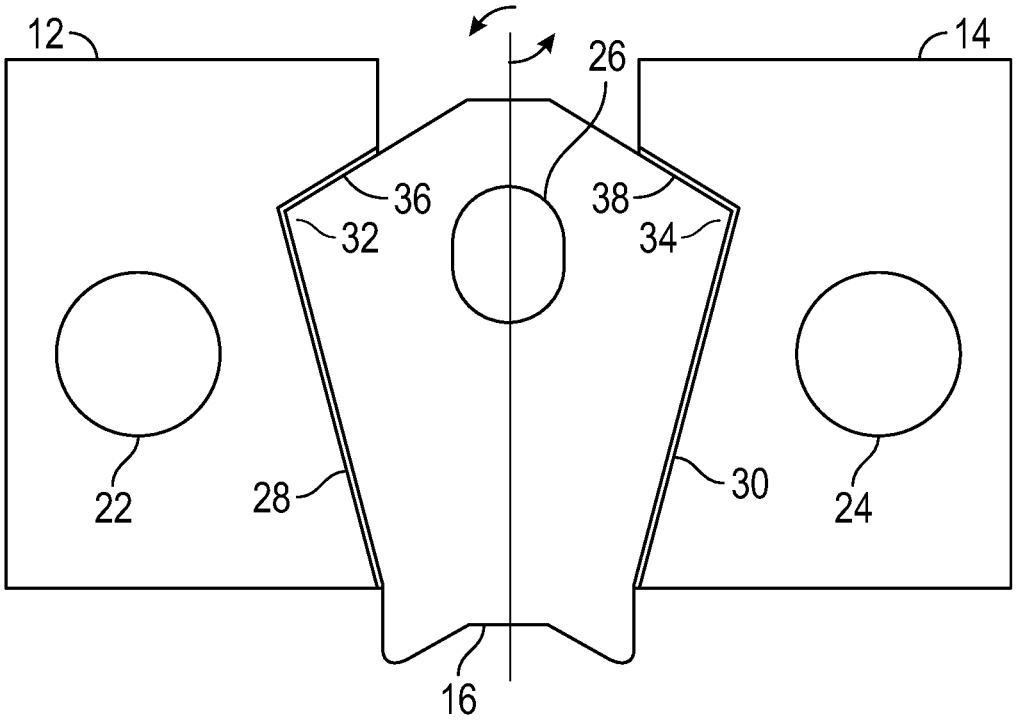
FIG. 1B is a front elevation view of the lifting system in FIG. 1A in accordance with one embodiment of the present invention.
Figure 1C:
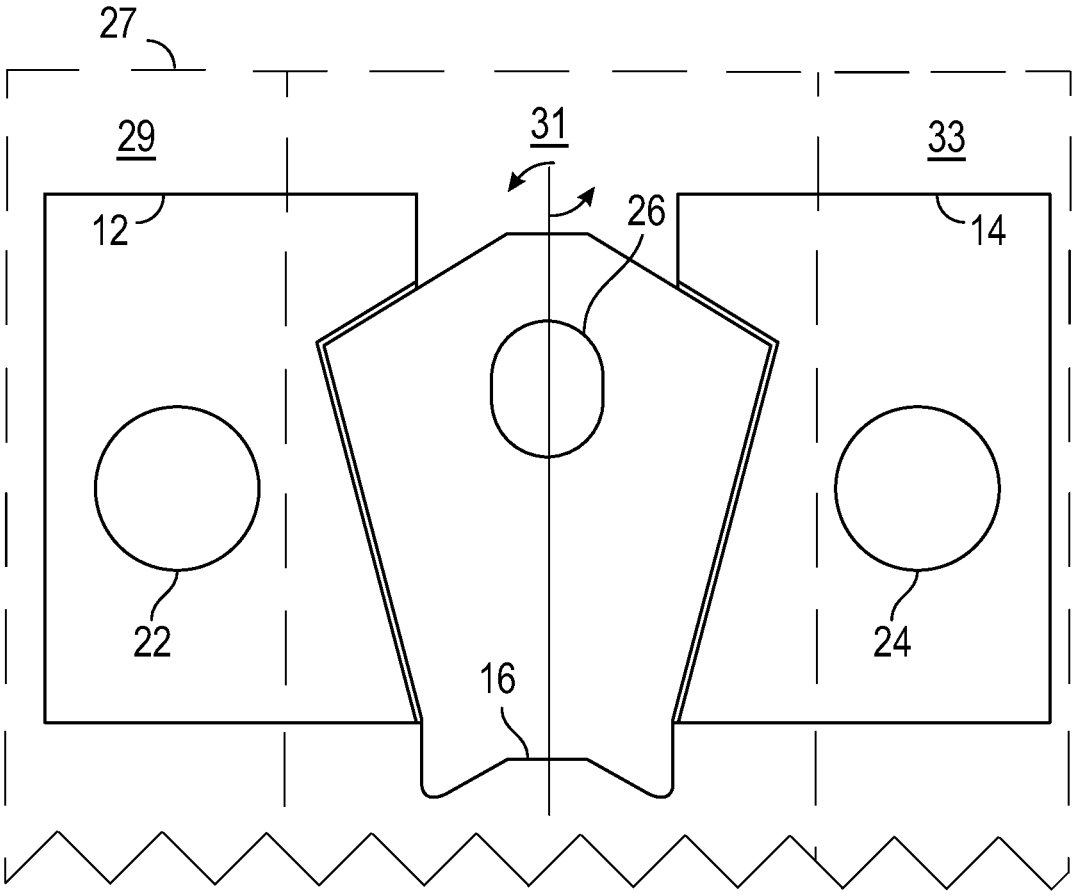
FIG. 1C is a front elevation view of the lifting system in FIG. 1A in accordance with one embodiment of the present invention.

Now referring to FIGS. 1A-1C, a perspective view and a front elevation view of the lifting system 10 are provided, respectively. The lifting system 10 generally comprises a first wing plate 12 and a second wing plate 14 positioned on either side of a central plate 16. Each wing plate 12, 14 is secured to a different concrete layer of the precast concrete structure 27, and the central plate 16 generally bridges the gap or insulation layer 31 between the concrete layers 29, 33. The first wing plate 12 has a first aperture 22 that can, for instance, receive reinforcement material such as metal, rebar grid, carbon fiber, etc. to secure the first wing plate 12 to the concrete layer. Similarly, the second wing plate 14 has a second aperture 24. The central plate 16 has a central aperture 26 to receive the bolt of a lifting clutch, which allows a hoisting system to lift the entire precast concrete structure for transportation and positioning the structure in a predetermined location and orientation.

As shown in FIG. 1A, the lifting system 10 has a void former 18 that is coupled to the uppers ends of the plates 12, 14, 16. The void former 18 defines a recess in the precast concrete structure so that the bolt of the lifting clutch can be positioned in the central aperture 26 to move the entire precast concrete structure. The void former 18 also at least partially defines a space 20 to allow the central plate 16 to rotate about an axis and disengage from the wing plates 12, 14, and either be removed from the lifting system 10 or break the insulation bridge between the concrete layers of the precast concrete structure. The rotation of the central plate 16 can be performed with a rigid member through central aperture 26 to generate mechanical advantage about the rotational axis. It will be appreciated that the void former 18 can define the entire space 20 required for the central plate 16 to rotate out of engagement with the wing plates 12, 14. However, it will be further appreciated that in some embodiments, the void former 18 can partially define the space 20, and, for instance, a second void former defines the remaining portion of the space 20. The space 20, in various embodiments, can simply be part of the insulation layer that is compressed or otherwise displaced as the central plate 16 rotates.

As shown in FIG. 1B, the configuration of the plates 12, 14, 16 allows the central plate 16 to transfer a lifting load to the wing plates 12, 14. Generally, the plates 12, 14, 16 are aligned in a common plane, and a first recess 18 in the first wing plate 12 receives a first extension 32 of the central plate 16, and a second recess 30 in the second wing plate 14 receives a second extension 34 of the central plate 16. When a lifting clutch is placed in the central aperture 26 and a hosting system applies a vertical force to the lifting clutch, the central plate 16 transfers the vertical force to lifting edges 36, 38 of the first and second extensions 32, 34, which in turn transfers the vertical force to the first and second wing plates 12, 14 and the concrete layers of the precast concrete structure.

Figure 1D:
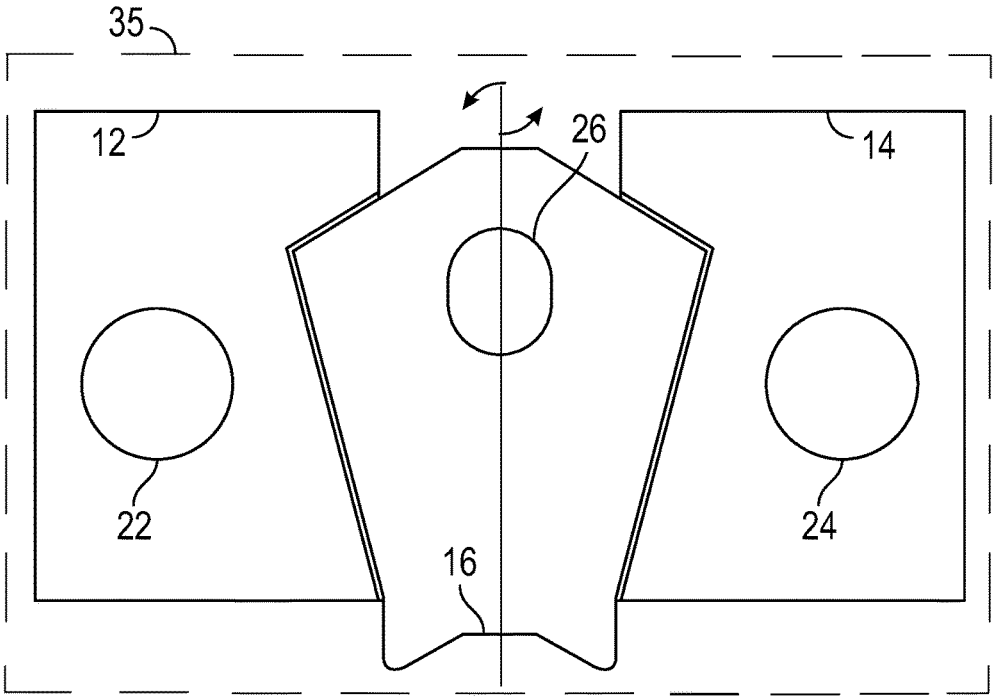
FIG. 1D is a front elevation view of the lifting system in FIG. 1A in accordance with one embodiment of the present invention.

To retain the planar alignment of the plates 12, 14, 16 during lifting, the plates 12, 14, 16 can be packaged into a single plastic casing 35, as shown in FIG. 1D. This casing resists out-of-plane forces to maintain the alignment of the plates 12, 14, 16 and to keep the lifting edges 36, 38 intact to transfer forces between the plates 12, 14, 16. In some embodiments, the plates 12, 14, 16 can connect to each other with a tongue-and-groove connection to resist out-of-plane forces until a predetermined rotational force is applied to the central plate 16. The tongue-and-groove connection can have a squared or curved cross-sectional profile, and either plate can have either component of the connection. In addition, the void former 18 is coupled to the upper ends of the plates 12, 14, 16 and can, in various embodiments, also serve the function of maintaining the planar alignment of the plates 12, 14, 16.

After the precast concrete structure is positioned in the predetermined location and orientation, the thermal bridge between the concrete layers and between the first and second wing plates 12, 14 can be broken. In some embodiments, a predetermined torque or moment force is applied to the central plate 16 to rotate the central plate 16 about an axis and out of planar alignment with the wing plates 12, 14. The predetermined force may be sufficient to break one or more of the plastic casing and residual forces from the wing plates 12, 14 or other components of the precast concrete structure. The rotation can also be characterized as a predetermined rotation about the axis in FIG. 1B. For example, in some embodiments, the predetermined rotation of the central plate 16 is between 0 and 30 degrees. In various embodiments, the predetermined rotation is 90 degrees. Further, the predetermined rotation can be between 0 and 90 degrees. Once out of alignment, the central plate 16 can be left in the gap or insulation layer between the concrete layers. Alternatively, the central plate 16 can be left in place. Further, the recess, space 20, or void left from the removed central plate 16 can be filled with additional material such as grout, insulation material, precast concrete, etc.

Figure 2:
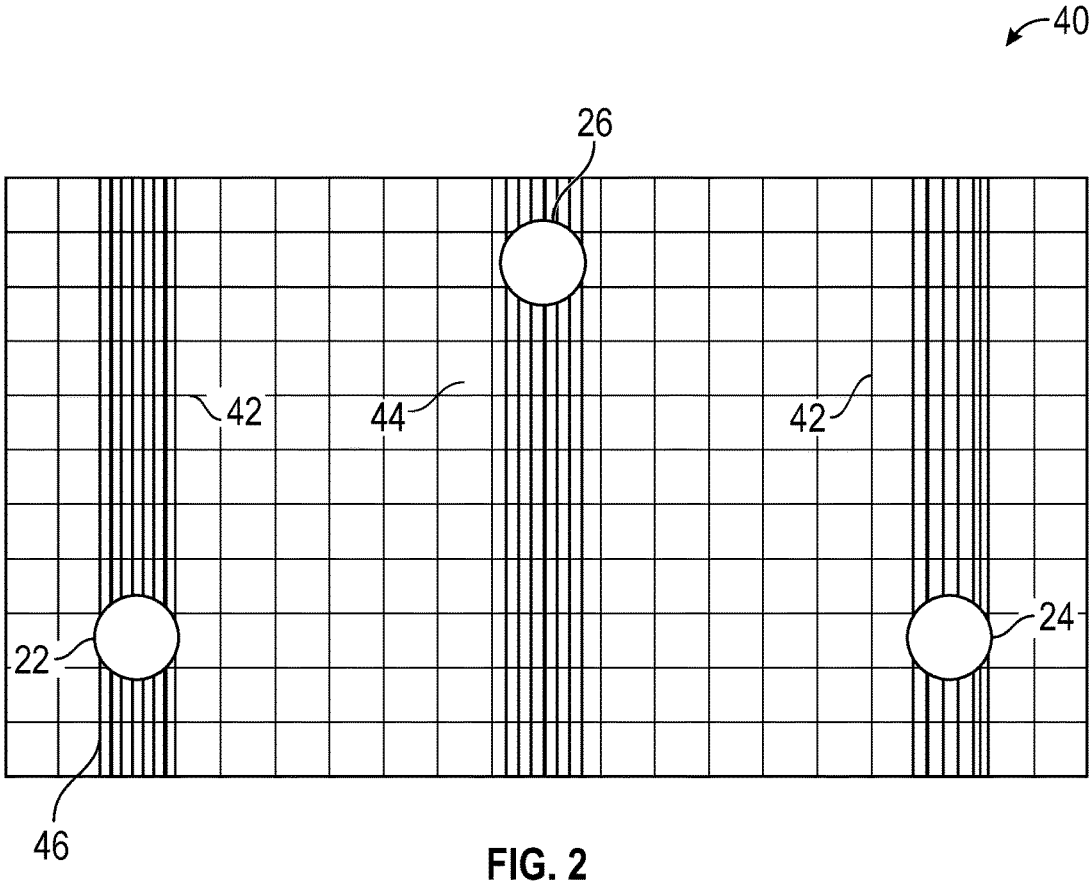
FIG. 2 is a front elevation view of a lifting system in accordance with one embodiment of the present invention.

Now referring to FIG. 2, a front elevation view of a lifting anchor or lifting plate 40 is provided. Similar to the wing plates 12, 14 and the central plate 16 described in FIGS. 1A and 1B, the lifting plate 40 in FIG. 2 has a first aperture 22 and a second aperture 24 to secure the lifting plate 40 to concrete layers of a precast concrete structure. In addition, the lifting plate 40 has a central aperture 26 to receive the bolt of a lifting clutch, which allows a hoisting system to lift the entire precast concrete structure and position the structure in a predetermined location and orientation. Unlike the plates 12, 14, 16 in the lifting system 10 in FIGS. 1A and 1B, the lifting plate 40 in FIG. 2 is a continuous plate.

To prevent a thermal bridge between concrete layers, the lifting plate 40 can comprise a material such as fiberglass, carbon fiber, carbon fiber mats, or other materials described herein that insulate against heat transfer between the concrete layers. The lifting plate 20 can be a composite material made from a woven layer 42 and a binding layer 44. The woven layer 42 can extend to form a grid-like pattern as shown in FIG. 2, or any other type of pattern, and the woven layer 42 can be comprised of, for example, a carbon fiber or glass fiber material. The binding layer 44 can be, for example, a resin that supports the woven layer 42. It will be appreciated that the thermal conductivity of the lifting plate 40 is less than $$0.25\,\frac{W}{m\cdot K}$$

in some embodiments, and less than $$0.15\,\frac{W}{m\cdot K}$$

in further embodiments.

Filament windings 46 can interweave with the woven layer 42 and/or binding layer 44 to reinforce the apertures against vertical forces. Accordingly, a filament winding 46 can be oriented in a vertical direction of the plate 40 and aligned with an aperture in the horizontal direction of the plate 40. Multiple filament windings 46 can reinforce a single aperture. As depicted in FIG. 2, each aperture 22, 24, 26 has at least one reinforcing filament winding 46, which can be metallic wire in some embodiments or a less thermally conductive fiber such as those used in the woven layer 42.

Figure 3C:
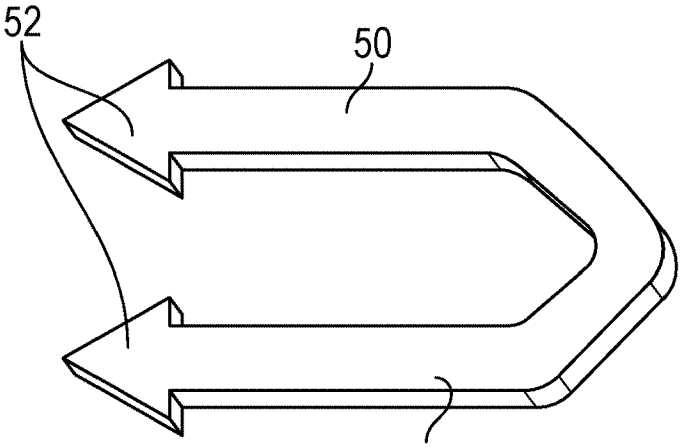
FIG. 3C is a perspective view of a lifting system in accordance with one embodiment of the present invention.
Figure 3D:
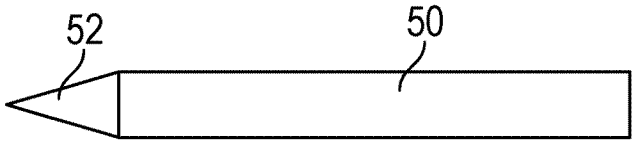
FIG. 3D is a side elevation view of the lifting system in FIG. 3C in accordance with one embodiment of the present invention.
Figure 3B:
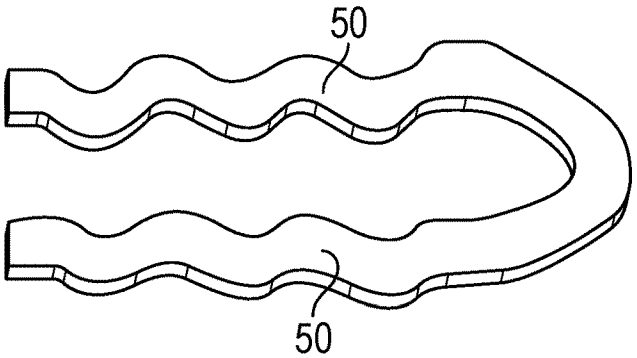
FIG. 3B is a perspective view of a lifting system in accordance with one embodiment of the present invention.
Figure 3A:
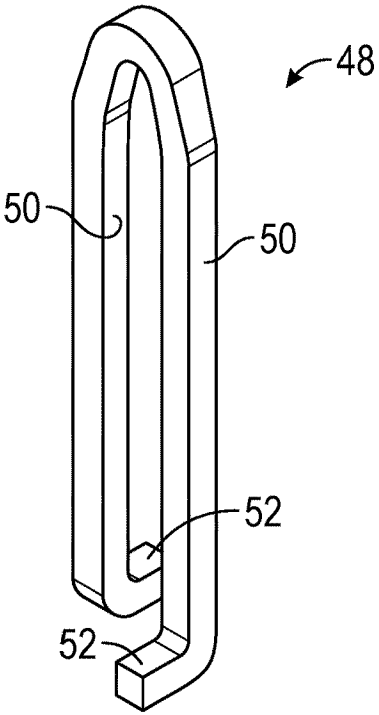
FIG. 3A is a perspective view of a lifting system in accordance with one embodiment of the present invention.

Now referring to FIGS. 3A-3D, various alternative embodiments of a lifting anchor 48 are provided. The anchor 48 is a bar-type lifting anchor and can be embedded into the concrete layers of the precast concrete structure to allow for the hoisting and positioning of the precast concrete structure. Referring to FIG. 3A, the anchor 48 in one embodiment comprises two legs 50 and an end 52 positioned on the distal portion of each leg 50. The legs 50 are joined together at a proximal portion of each leg 50 where the joint portion has a predetermined radius, and the ends 52 extend from the legs 50 at approximately 90°. In the depicted embodiment, the legs 50 are substantially parallel to each other, however, it will be appreciated that the legs 50 can have different orientations relative to each other. It will be further appreciated that the anchor 48 can include greater or fewer legs 50 than two, and greater or fewer ends 52 per leg 50 than one.

Now referring to FIG. 3B, a perspective view of another embodiment of an anchor 48 is provided. This anchor 48 has no ends 52 and has legs 50 with a non-linear shape, which in this embodiment is in the form of a sinusoidal wave. It will be appreciated that the legs 50 may have other shapes including waves, ridged, sawtooth, parabolic, n-order polynomial, etc.

Now referring to FIGS. 3C-3D, a perspective view and a side elevation view of yet another embodiment of an anchor 48 is provided. This anchor 48 has ends 52 with a triangular shape having a maximum width greater than the width of the respective leg 50, which provides improved anchoring in the concrete layers of the precast concrete structure. Further ends 52 may be conical or pyramidal in shape. It will be appreciated that the anchor 48 may have any combination of leg 50 and end 52 described herein. The anchor 48 can be made from fiberglass, carbon fiber, or other materials discussed herein to prevent a thermal bridge between concrete layers of the precast concrete structure. In addition, the anchor 48 can include oriented fibers such as carbon or glass formed into a prismatic section by pultrusion or injection molding.

The anchor 48 described in FIGS. 3A-3D can provide a lifting location on a face of a concrete layer or wythe. For example, an insulation precast concrete panel can be manufactured such that a first concrete layer is poured and remains plastic, and an insulation layer is placed on top of the first concrete layer. Then, for instance, the ends 52 of the anchor in FIGS. 3C-3D can be driven through the insulation layer and into the first concrete layer, which is still plastic. A void former can be placed around the exposed part of the anchor, and a second concrete layer can be poured on top of the insulation layer. As a result, the anchor spans the concrete layers and also provides a lifting location on a face of one of the concrete layers.

The description of the present invention has been presented for purposes of illustration and description, but is not intended to be exhaustive or limiting of the invention to the form disclosed. Many modifications and variations will be apparent to those of ordinary skill in the art. The embodiments described and shown in the figures were chosen and described in order to best explain the principles of the invention, the practical application, and to enable those of ordinary skill in the art to understand the invention.

While various embodiments of the present invention have been described in detail, it is apparent that modifications and alterations of those embodiments will occur to those skilled in the art. Moreover, references made herein to "the present invention" or aspects thereof should be understood to mean certain embodiments of the present invention and should not necessarily be construed as limiting all embodiments to a particular description. It is to be expressly understood that such modifications and alterations are within the scope and spirit of the present invention, as set forth in the following claims.

What is claimed is:

1. A lifting apparatus for reducing heat transfer between concrete layers of a precast concrete panel, comprising:

a first wing plate having a first recess, said first wing plate adapted for connection to a first concrete layer of a precast concrete panel;

a second wing plate having a second recess, said second wing plate adapted for connection to a second concrete layer of said precast concrete panel;

a central plate having a first extension at least partially disposed in said first recess of said first wing plate, wherein a first lifting edge of said first extension contacts said first wing plate, and said central plate having a second extension at least partially disposed in said second recess of said second wing plate, wherein a second lifting edge of said second extension contacts said second wing plate; and wherein said lifting edges are configured to transfer a force from said central plate to said wing plates, wherein said first wing plate, said second wing plate, and said central plate each have a substantially planar shape and lie in a common plane, and wherein said central plate is configured to selectively rotate out of said common plane with said wing plates to disengage said lifting edges from said wing plates.

2. The apparatus of claim 1, further comprising:

a casing enclosing at least a portion of said first wing plate, at least a portion of said second wing plate, and at least a portion of said central plate to maintain an alignment of said plates in said common plane prior to rotation of said central plate.

3. The apparatus of claim 1, wherein said central plate has a central aperture configured to receive a lifting mechanism, said first wing plate comprises an aperture adapted for connection to said first concrete layer of said precast concrete panel, and said second wing plate comprises an aperture adapted for connection to said second concrete layer of said precast concrete panel.

4. The apparatus of claim 1, wherein said first lifting edge forms a first angle with a horizontal direction of said apparatus, and said second lifting edge forms a second angle with said horizontal direction, wherein said first and second angles are between approximately 25 and 45 degrees.

5. The apparatus of claim 1, wherein a first side edge of said first extension contacts said first wing plate, and a second side edge of said second extension contacts said second wing plate, wherein said side edges are substantially oriented in a vertical direction of said apparatus.

6. A lifting system for reducing heat transfer between concrete layers of a precast concrete panel, comprising:

a precast concrete panel having a first concrete layer, a second concrete layer, and an insulation layer positioned between said concrete layers;

a first wing plate embedded in said first precast concrete layer;

a second wing plate embedded in said second precast concrete layer, wherein said first wing plate and said second wing plate are aligned in a common plane; and a central plate having a first extension at least partially disposed in a first recess of said first wing plate, wherein a first lifting edge of said first extension contacts said first wing plate, and said central plate having a second extension at least partially disposed in a second recess of said second wing plate, wherein a second lifting edge of said second extension contacts said second wing plate, and wherein said central plate is configured to selectively rotate out of said common plane to disengage said lifting edges from said wing plates.

7. The system of claim 6, further comprising a void former at least partially defining a space around said central plate.

8. The lifting system of claim 7, wherein said void former has a slot that engages at least a portion of said first wing plate, at least a portion of said second wing plate, and at least a portion of said central plate to retain alignment of said first wing plate, said second wing plate, and said central plate in said common plane.

9. The lifting system of claim 6, wherein said first wing plate, said second wing plate, and said central plate are encased into a single plastic casing.

10. The lifting system of claim 6, wherein said first and second lifting edges are configured to disengage from said wing plates when a predetermined torque is applied to said central plate about an axis aligned with said common plane.

11. The lifting system of claim 6, wherein at least one of said first wing plate, said second wing plate, and said central plate comprises at least one of a steel material, a plurality of oriented fibers, a fiberglass material, a carbon fiber material, a woven fiber reinforced by filament windings, and combinations thereof.

12. The lifting system of claim 6, wherein said first wing plate has an aperture configured to connect to a reinforcement structure of said first concrete layer, and said second wing plate has an aperture configured to connect to said reinforcement structure.

13. The lifting system of claim 12, wherein said central plate has an aperture configured to receive a lifting force, wherein said lifting force is transmitted through said lifting edges to said wing plates and to said concrete layers.

14. A lifting apparatus for reducing heat transfer between concrete layers of a precast concrete panel, comprising:

a first wing plate having a first recess, said first wing plate comprises an aperture adapted for connection to a first concrete layer of a precast concrete panel;

a second wing plate having a second recess, said second wing plate having an aperture adapted for connection to a second concrete layer of said precast concrete panel;

a central plate having a first extension at least partially disposed in said first recess of said first wing plate, wherein a first lifting edge of said first extension contacts said first wing plate, and said central plate having a second extension at least partially disposed in said second recess of said second wing plate, wherein a second lifting edge of said second extension contacts said second wing plate, and wherein said central plate has a central aperture configured to receive a lifting mechanism; and wherein said lifting edges are configured to transfer a force from said central plate to said wing plates, and wherein said central plate is configured to selectively rotate out of a common plane with said wing plates to disengage said lifting edges from said wing plates.

15. The apparatus of claim 14, further comprising:

a casing enclosing at least a portion of said first wing plate, at least a portion of said second wing plate, and at least a portion of said central plate to maintain an alignment of said plates in said common plane prior to rotation of said central plate.

16. The apparatus of claim 14, wherein said first lifting edge forms a first angle with a horizontal direction of said apparatus, and said second lifting edge forms a second angle with said horizontal direction, wherein said first and second angles are between approximately 25 and 45 degrees.

17. The apparatus of claim 14, wherein a first side edge of said first extension contacts said first wing plate, and a second side edge of said second extension contacts said second wing plate, wherein said side edges are substantially oriented in a vertical direction of said apparatus.

18. The apparatus of claim 14, wherein said first and second lifting edges are configured to disengage from said wing plates when a predetermined torque is applied to said central plate about an axis aligned with said common plane.

19. The apparatus of claim 14, wherein at least one of said first wing plate, said second wing plate, and said central plate comprises at least one of a steel material, a plurality of oriented fibers, a fiberglass material, a carbon fiber material, a woven fiber reinforced by filament windings, or combinations thereof.

20. The apparatus of claim 14, wherein said central aperture of said central plate is configured to receive a lifting force from said lifting mechanism, wherein said lifting force is transmitted through said lifting edges to said wing plates and to said concrete layers.

* * * * *